US009954274B2

(12) United States Patent
Nakada et al.

(10) Patent No.: US 9,954,274 B2
(45) Date of Patent: Apr. 24, 2018

(54) ANTENNA DEVICE

(71) Applicant: YOKOWO CO., LTD., Tokyo (JP)

(72) Inventors: Noriyoshi Nakada, Tomioka (JP); Masashi Noda, Tomioka (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 14/430,961

(22) PCT Filed: Sep. 19, 2013

(86) PCT No.: PCT/JP2013/075222
§ 371 (c)(1),
(2) Date: Mar. 25, 2015

(87) PCT Pub. No.: WO2014/050673
PCT Pub. Date: Apr. 3, 2014

(65) Prior Publication Data

US 2015/0244067 A1 Aug. 27, 2015

(30) Foreign Application Priority Data

Sep. 26, 2012 (JP) ..... 2012-212173

(51) Int. Cl.
*H01Q 1/42* (2006.01)
*H01Q 1/32* (2006.01)
(Continued)

(52) U.S. Cl.
CPC ..... *H01Q 1/42* (2013.01); *H01Q 1/1214* (2013.01); *H01Q 1/3275* (2013.01); *H01Q 1/48* (2013.01)

(58) Field of Classification Search
CPC .. H01Q 1/1271; H01Q 1/3275; H01Q 1/1278; H01Q 1/3291; H01Q 1/3283; H01Q 1/42
(Continued)

(56) References Cited

U.S. PATENT DOCUMENTS 4,395,713 A 7/1983 Nelson et al.
5,757,327 A * 5/1998 Yajima ..... H01Q 21/061 343/700 MS
(Continued)

FOREIGN PATENT DOCUMENTS

CN 1764008 A 4/2006
CN 101523662 A 9/2009
(Continued)

OTHER PUBLICATIONS

International Search Report dated Dec. 24, 2013 for International application No. PCT/JP2013/075222.
(Continued)

*Primary Examiner* — Huedung Mancuso
(74) *Attorney, Agent, or Firm* — Morgan, Lewis & Bockius LLP

(57) ABSTRACT

An antenna device includes: a case; a board which is encased in the case and receives a signal from an antenna element; and a base for which closes a bottom face of the case. The base is integrally provided with a metal fastening member, and includes a sheet metal part for conducting earth connection between an earth electrode of the board and a vehicle panel, and the sheet metal part is surrounded with resin to be integrally molded therewith.

10 Claims, 6 Drawing Sheets

(51) Int. Cl.
*H01Q 1/48* (2006.01)
*H01Q 1/12* (2006.01)

(58) Field of Classification Search
USPC ..... 343/711–715
See application file for complete search history.

(56) References Cited

U.S. PATENT DOCUMENTS

| | | | | |
|---|---|---|---|---|
| 6,535,171 | B1 * | 3/2003 | Lauermann | B60H 1/262 296/208 |
| 7,019,701 | B2 * | 3/2006 | Ohno | H01Q 1/3275 343/713 |
| 7,271,773 | B2 * | 9/2007 | Gorai | H01Q 1/3275 343/711 |
| 8,816,917 | B2 * | 8/2014 | Ueno | H01Q 1/3275 343/713 |
| 8,941,544 | B2 * | 1/2015 | Kobayashi | H01Q 1/3275 248/206.2 |
| 9,153,864 | B2 * | 10/2015 | Iwata | H01Q 1/085 |
| 9,225,055 | B2 * | 12/2015 | Kaneko | H01Q 1/3275 |
| 2003/0076270 | A1 | 4/2003 | Okamoto | |
| 2004/0150572 | A1 | 8/2004 | Ohno et al. | |
| 2006/0071868 | A1 * | 4/2006 | Gorai | H01Q 1/3275 343/715 |
| 2006/0097937 | A1 | 5/2006 | Gorai et al. | |
| 2006/0109186 | A1 * | 5/2006 | Yamada | H01Q 1/3275 343/713 |
| 2007/0031198 | A1 | 2/2007 | Silva | |
| 2008/0100521 | A1 | 5/2008 | Herbert et al. | |
| 2009/0295678 | A1 | 12/2009 | Noro et al. | |
| 2011/0267243 | A1 | 11/2011 | Steinkamp et al. | |

FOREIGN PATENT DOCUMENTS

| | | | |
|---|---|---|---|
| EP | 0862239 | A1 | 9/1998 |
| GB | 2487853 | A | 8/2012 |
| JP | 2001054251 | A | 2/2001 |
| JP | 2001-223040 | A | 8/2001 |
| JP | 2002-246818 | A | 8/2002 |
| JP | 2003-234608 | A | 8/2003 |
| JP | 2004-228954 | A | 8/2004 |
| JP | 2006-121369 | A | 5/2006 |
| JP | 2008-182663 | A | 8/2008 |
| JP | 2009-177427 | A | 8/2009 |
| JP | 2009-296095 | A | 12/2009 |
| JP | 2011-047479 | A | 3/2011 |
| JP | 2011-061526 | A | 3/2011 |
| JP | 2011-188253 | A | 9/2011 |

OTHER PUBLICATIONS

Extended European Search Report dated Apr. 22, 2016, for corresponding European Patent Application No. 13840436.3.
Chinese Office Action issued in related Chinese Patent Application No. 201380050425.7 dated Sep. 19, 2016, which is attached along with the English translation of same.
Japanese Office Action dated May 24, 2017 in related Japanese Patent Application No. 2016-181818 with English translation of same.

* cited by examiner

PRIOR ART

ANTENNA DEVICE

TECHNICAL FIELD

The present invention relates to an antenna device which is appropriately applied to an on-vehicle antenna device to be mounted on a vehicle panel.

BACKGROUND ART

An on-vehicle radio antenna device generally includes: as shown in FIG. 10, an element 1 containing an antenna element for receiving radio waves; a case 2 for protecting an interior against bad weather; an amplifier board 3 for amplifying high frequency signals, which are received by the element 1; a cable (not shown) for transmitting the signals; abase 4 for holding components; and a nut 6 for fixing the base 4 to a vehicle panel 10. The amplifier board 3 is held on the base 4, a bottom face of the case 2 is closed with the base 4, and the amplifier board 3 is encased in the case 2. The element 1 is attached to an upper part of the case 2 (by screwing, for example, a female screw provided on the case 2 with a male screw provided on the element 1).

The base 4 of the on-vehicle radio antenna device has functions of holding the respective components, and fixing the antenna device to the vehicle panel 10 by means of the nut 6. Further, the base 4 has functions of conducting earth connection with respect to the vehicle panel 10, and so on. For this reason, conventionally, a die-cast product formed of metal has been a mainstream, because the die-cast product is produced from a material that can be formed in various shapes and has high strength, and through which electrical continuity can be achieved.

Generally, metal has a high specific gravity, and there has been a problem that the die-cast base formed of metal is heavy. Moreover, because metal has a high melting point, installation of molds is expensive, resulting in a high cost product. Further, because metal is electrically conductive, there is a risk that an accidental short-circuit may occur between the base and a cable for transmitting the received high frequency signals or a core wire of a power supply cable. On the other hand, there have been some structures in which a part of the base is formed of resin, which achieves weight reduction and cost reduction. However, the die-cast product is still a metallic part, and thus, cost reduction is not attained.

An example of the die-cast base formed of metal is disclosed in the below described Patent Document 1.

PRIOR ART DOCUMENT

Patent Document

Patent Document 1: JP-A-2009-296095

SUMMARY OF THE INVENTION

Problems that the Invention is to Solve

As described above, although the base of the conventional on-vehicle antenna device is generally formed of metal by die-casting, resin is more advantageous in respect of reduction of weight and cost. However, resin is an insulating material, and inappropriate as the material for the base of the on-vehicle antenna device in which earth connection between the amplifier board and the vehicle panel must be conducted.

This invention has been made in view of the above described circumstances, and an object of the invention is to provide an antenna device which is suitable to common use of components, and attains a low cost and light weight, by providing such a base structure that a sheet metal part is used in a region for performing earth connection, and the sheet metal part is surrounded with resin to be integrally molded therewith.

Means for Solving the Problems

One phase of the invention is an antenna device. This antenna device comprises: a case; a board which is encased in the case and receives a signal from an antenna element; and a base which closes a bottom face of the case, and the antenna device is characterized in that the base is integrally provided with a metal fastening member, and includes a sheet metal part for conducting earth connection between an earth electrode of the board and a vehicle panel, and the sheet metal part is surrounded with resin to be integrally molded therewith.

In the above described phase, it would be preferable that the sheet metal part is provided with at least one arm part which is erected from a bottom face part thereof, and the arm part is electrically connected to the earth electrode of the board.

In the above described phase, it is preferable that a plurality of the arm parts are provided, and the board is held by the plurality of the arm parts, and at least one of the arm parts has a folded part at a distal end thereof, the folded part being folded and soldered to the earth electrode.

In the above described phase, it is preferable that the metal fastening member is a stepped nut, which has a projected part in a center part thereof, and the sheet metal part is formed with a positioning hole with which the projected part is to be engaged.

In the above described phase, it is preferable that a reinforcing rib is formed by folding an edge of the bottom face part.

It is to be noted that desired combinations of the above described constituent elements and descriptions of the invention, which are converted between methods and systems, are also effective as the features of the invention.

Advantage of the Invention

According to the antenna device of the invention, by providing such a base structure that the sheet metal part is used in the region for performing the earth connection, and the sheet metal part is surrounded with resin to be integrally molded therewith, it is possible to form a major part of the antenna device from resin, which is lightweight, as compared with metal. Therefore, weight reduction can be achieved, and the base can be produced at a low cost, as compared with a die-cast product. Moreover, by commonly using the sheet metal part and by modifying a shape of the resin molded part, it is possible to cope with various situations, and common use of the component can be attained.

MODE FOR CARRYING OUT THE INVENTION

Figure 1:
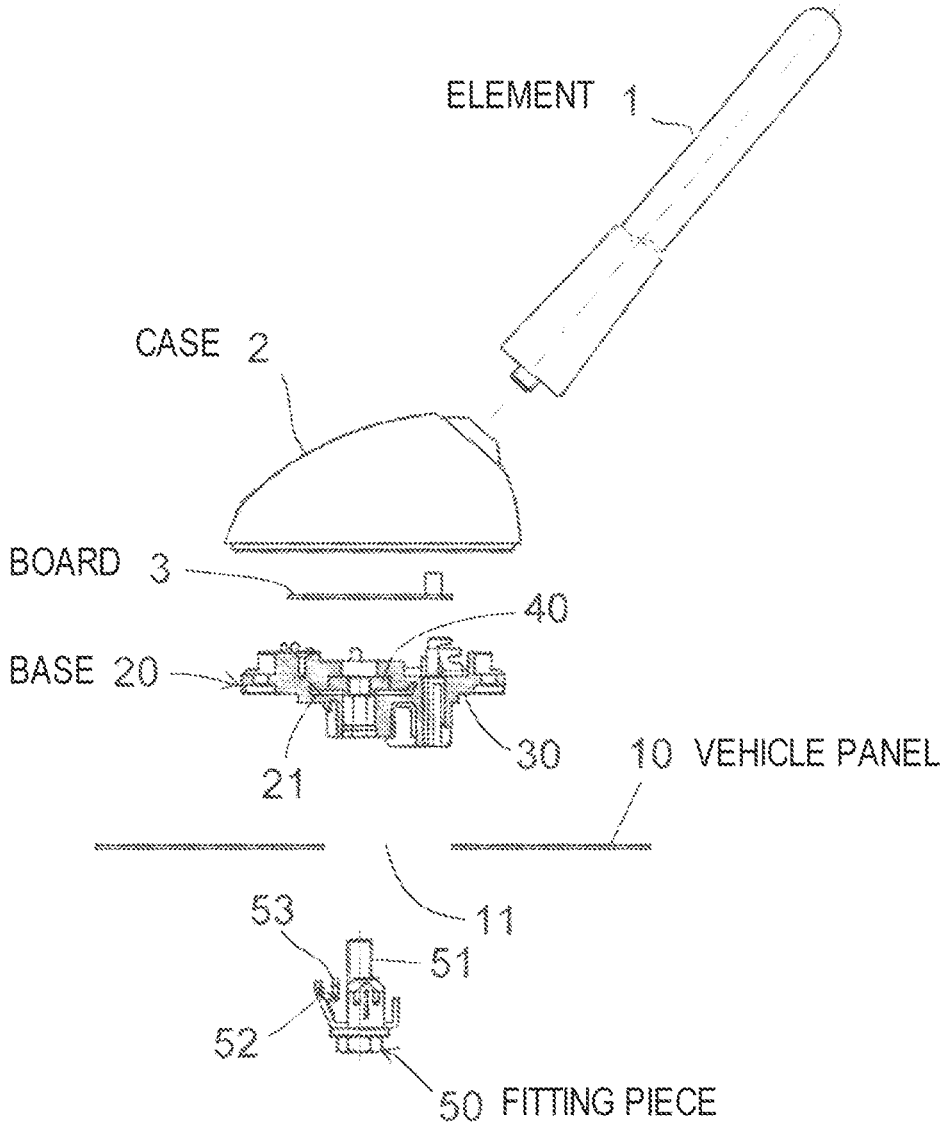
FIG. 1 is an exploded side view showing an entire structure of an antenna device in an embodiment according to the invention.

Now, preferred embodiments according to the invention will be described in detail, referring to the drawings. It is to be noted that the same or equivalent constituent elements, members, treatments that are shown in the drawings will be denoted with the same reference numerals, and overlapped descriptions will be appropriately omitted. Moreover, the embodiments do not limit the invention, but only exemplify the invention. All the features described in the embodiments and combinations thereof are not necessarily essential matters of the invention.

FIGS. 1 to 6 show an example of an on-vehicle radio antenna device that is an embodiment according to the invention. As shown in FIG. 1, the on-vehicle radio antenna device includes: an element 1 containing an antenna element (a rod antenna, a helical coil, etc.) for receiving radio waves; a case 2 for protecting the device interior from bad weather; an amplifier board 3 for amplifying high frequency signals that are received by the element 1; a cable 5 for transmitting the signals that are amplified by the amplifier board 3 and for supplying power to the amplifier board 3 (See FIG. 2); a base 20 for holding components; and a metal fitting piece 50 with a hook for fixing the base 20 to a vehicle panel 10 such as a vehicle roof in a shape of a metal plate. The element 1 is attached to an upper part of the case 2 (by screwing, for example, a male screw provided on the element 1 with a female screw provided on the case 2).

Figure 2:
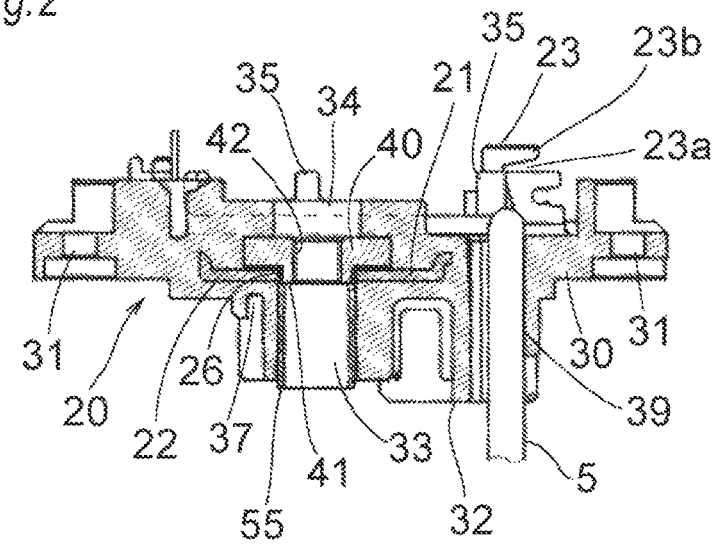
FIG. 2 is a sectional side view of a base for closing a bottom part of a case in the embodiment.
Figure 3:
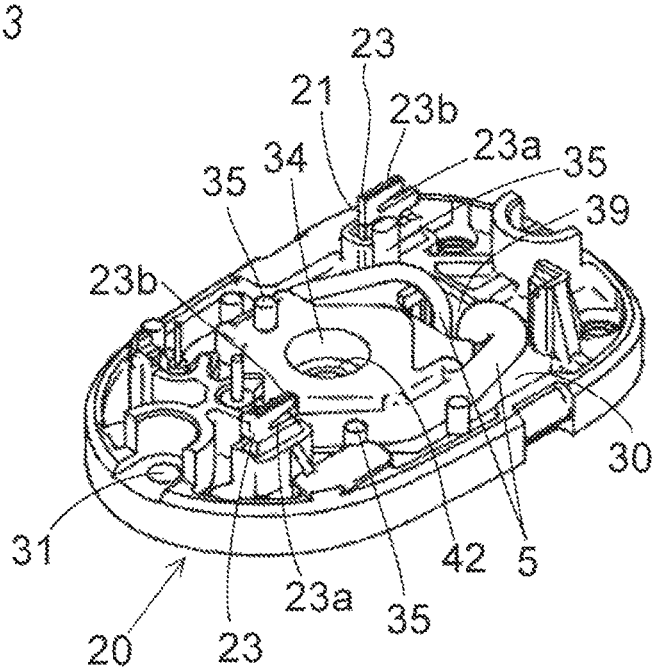
FIG. 3 is a perspective view of the base.
Figure 4:
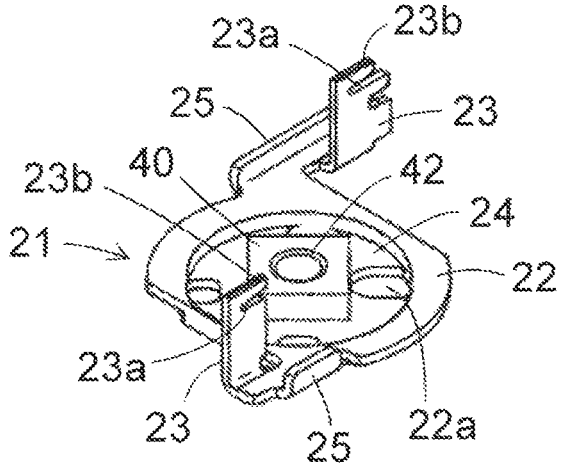
FIG. 4 is a perspective view of a sheet metal part which is provided in the base for earth connection.

The base 20 is formed as follows; As shown in FIGS. 2 to 4, a metal nut 40 as a metal fastening member is fixed to a sheet metal part 21 by welding or so, and this sheet metal part 21 is surrounded with resin to be integrally molded therewith (so-called insert molding). Therefore, the base 20 includes the sheet metal part 21 and a resin part 30, which is integral with the sheet metal part 21. The base 20 is so arranged as to block (close) a bottom face of the case 2, and fixed to the case 2 with small screws, byway of fitting holes 31 provided in a peripheral part of the resin part 30.

As shown in FIG. 4, the sheet metal part 21 has a bottom face part 22, and a pair of (a plurality of) arm parts 23 which are vertically erected from the bottom face part 22 at diagonal positions. Moreover, a stepped face 24 in a round shape is formed on the bottom face part 22 by drawing work, and reinforcing ribs 25 are formed by folding an edge of the bottom face part 22. The stepped face 24 and the reinforcing ribs 25 are provided for improving bending strength, in case where the sheet metal part 21 has a thin wall thickness. Relief holes 22*a* are formed in the bottom face part 22 (the stepped face 24) for weight reduction. As seen from FIG. 2, the metal nut 40 is a stepped nut (a nut with a pilot) having a projected part 41 in a center part thereof, and a nut positioning hole 26 to be engaged with the projected part 41 is formed in a center part of the bottom face part 22. In order to secure the electrical connection between the sheet metal part 21 and the metal nut 40, the metal nut 40 is fixed to the sheet metal part 21 by welding or soldering.

The resin part 30 has a profile in a substantially oblong shape, and an engaging protruded part 32, which is so shaped as to be engaged with a square-shaped mounting hole 11 in the vehicle panel 10 (a vehicle roof, for example). The mounting hole is formed in a center part on a lower face side of the resin part 30. The engaging protruded part 32 has a hole 33 to which a female screw hole 42 of the metal nut 40 is exposed. Another hole 34, to which the female screw hole 42 of the metal nut 40 is exposed, is formed also on an upper face side of the resin part 30. A metal tube 55 is press-fitted into the hole 33, after the resin part 30 has been molded. An upper end of the metal tube 55 is in contact with the projected part 41 of the metal nut 40. The engaging protruded part 32 is provided with a cable drawing hole 39 so as to pass it through, and the cable 5, which is connected to the amplifier board 3, is drawn out to the exterior through the cable drawing hole 39.

Figure 5:
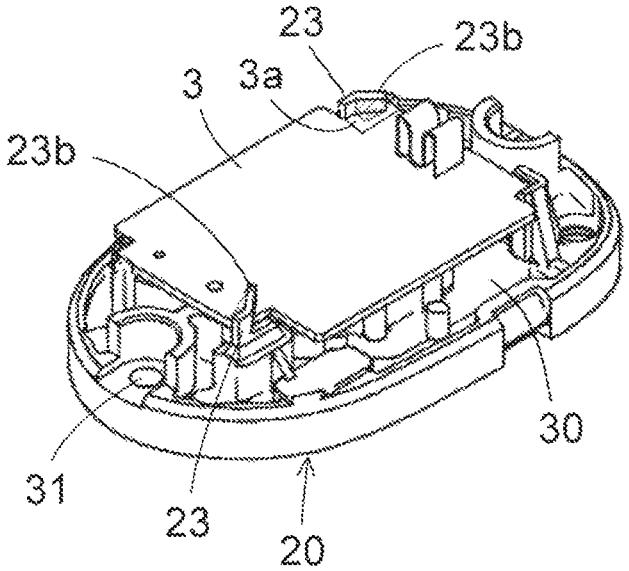
FIG. 5 is a perspective view in a state where an amplifier board is fixed on the base.

As shown in FIGS. 2 and 3, a plurality of the arm parts 23, which are erected from the sheet metal part 21, are projected from the upper face of the resin part 30. An upper end of each of the arm parts 23 is provided with a slit 23*a* thereby being formed as a folded part 23*b*, which is foldable. Moreover, a plurality of bosses 35 for supporting a lower face of the amplifier board 3 at a predetermined height are formed on the upper face of the resin part 30. Then, the amplifier board 3 is mounted on the base 20, specifically, between the arm parts 23 provided at a pair of diagonal positions, as shown in FIG. 5. Thereafter, the folded parts 23*b* of the arm parts 23 are folded and soldered to earth electrodes 3*a* of the amplifier board 3, and electrically connected by means of conductive bonding agent or the like. In a state where the amplifier board 3 is mounted on the base 20 and held by the arm parts 23, as shown in FIG. 5, the amplifier board 3 is encased in the case 2.

Figure 6:
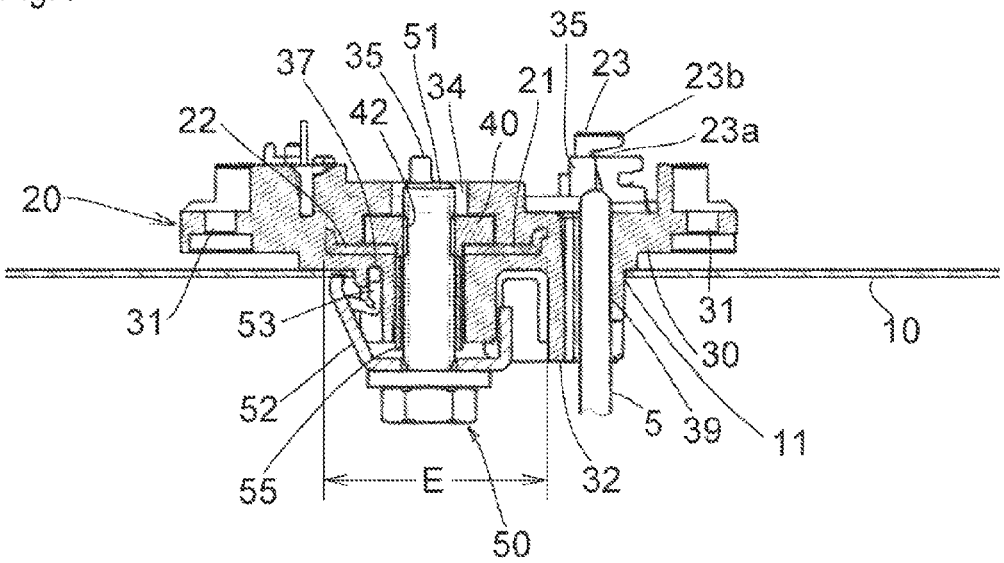
FIG. 6 is a sectional side view in a state where the base is mounted on a vehicle panel, and a bolt part of a metal fitting piece is tightened with a nut on the base side by screwing.

FIG. 6 shows the base 20 in a state mounted on the vehicle panel 10, and tightened by screwing the bolt part 51 of the metal fitting piece 50 with the nut 40 on the base side. It is to be noted that the case 2 and the amplifier board 3 are not shown in the drawing. As shown in FIG. 6, mounting of the base 20 to the vehicle panel 10 is conducted, by engaging the engaging protruded part 32 on the lower face of the base 20 with the square-shaped mounting hole 11, by screwing the bolt part 51 of the metal fitting piece 50 with a hook 52 into the female screw hole 42 of the metal nut 40, and by tightening an inwardly folded arm 53 in an L-shape, which is integrally formed on the hook 52 in a state engaged with a locking groove 37 on the lower face of the resin part 30. In this manner, the hook 52 provided around the bolt part 51 of the metal fitting piece 50 bites into a face of the vehicle panel 10 thereby to electrically connect the metal fitting piece 50 to the vehicle panel 10. Accordingly, the earth electrode 3*a* of the amplifier board 3 is electrically connected to the vehicle panel 10 by way of the arm parts 23 of the sheet metal part 21, the bottom face part 22, the metal nut 40, and the bolt part 51 and the hook 52 of the metal fitting piece 50, and thus, the earth connection between the earth electrode 3*a* and the vehicle panel 10 is established. Because the metal tube 55 exists around the bolt part 51, the metal fitting piece 50 is tightened up to such an extent that an upper face of a base part of the hook 52 comes into contact with the metal tube 55. Moreover, the sheet metal part 21 is set to have a larger size than an outer diameter of a tip end of the hook 52. Therefore, the tip end of the hook 52 is positioned within a range of a lower face region of the sheet metal part 21 (a range shown by an arrow mark E in FIG. 6), and the sheet metal part 21 can bear a pressure of the tip end of the hook 52 which is generated by tightening the bolt part 51. As a result, a large stress will not be applied to the resin part 30 of the base 20, thus enabling the base 20 to be reliably fixed by tightening.

According to this embodiment, the following advantages can be obtained.

(1) A major part of the material for the base 20 is formed of resin, which has a smaller specific gravity, instead of metal, which has a larger specific gravity. Therefore, reduction of weight can be achieved, as compared with the conventional base formed of metal by die-casting.

(2) In case of the base formed of metal by die-casting, installation of molds is expensive, because metal having a high melting point is used. To the contrary, in case of the resin molded base, the installation is simple, and the material itself is cheap. Therefore, the base 20 having the sheet metal part 21, which is surrounded with resin to be integrally molded, can be produced at a low cost.

(3) The conventional base formed of metal by die-casting is electrically conductive, and therefore, when the base comes into contact with a cable for radio signals or a power supply cable of the amplifier board 3, there is a risk that an accidental short-circuit may occur. However, in the base 20 in this embodiment in which the sheet metal part 21 is covered with the resin part 30, electricity does not flow on a surface of the base 20, and the short circuit between the base 20 and the cable for radio signals or the power supply cable of the amplifier board 3 can be prevented. As a result, a product having high safety can be obtained.

(4) As the material for the sheet metal part, the material having excellent solderability such as tinplate can be selected. Accordingly, it is possible to hold the amplifier board 3 by soldering connection, without using the screws or the like, thus reducing the number of components, weight, and cost.

Figure 7:
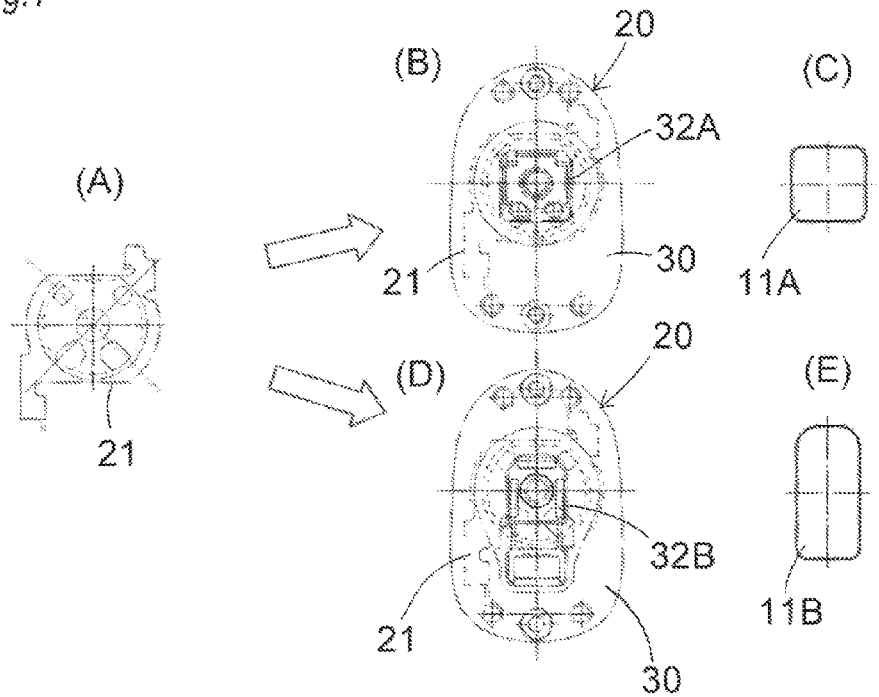
FIGS. 7(A)-7(E) are explanatory views in case where a shape of a protruded part of the base is modified corresponding to a shape of a hole in the vehicle panel, by commonly using the sheet metal part.

FIG. 7 is a view for explaining a case where a shape of the protruded part of the base 20 is modified according to a shape of the mounting hole on the vehicle panel side, by commonly using the sheet metal part. The sheet metal part 21 in (A) of FIG. 7 is common to the sheet metal part in the embodiment as described referring to FIGS. 1 to 5. Where an engaging protruded part 32A of the resin part 30, which is integrally formed with the sheet metal part 21, is formed in a substantially tubular shape having a substantially square shape in cross section, as shown in (B) of FIG. 7, it is possible to realize a base structure conformable to a mounting hole 11A having a substantially square shape, as shown in (C) of FIG. 7. Moreover, where an engaging protruded part 32B of the resin part 30 is formed in a substantially tubular shape having a substantially oblong shape in cross section, as shown in (D) of FIG. 7, it is possible to realize a base structure conformable to a mounting hole 11B having a substantially oblong shape, as shown in (E) of FIG. 7.

As described above referring to FIG. 7, it is possible to realize the structure conformable to the mounting hole of the vehicle panel which has various shapes and sizes, by commonly using the sheet metal part 21 for holding the amplifier board 3 and conducting the earth connection, and by modifying the shape of the resin molded part surrounding the sheet metal part.

Figure 8:
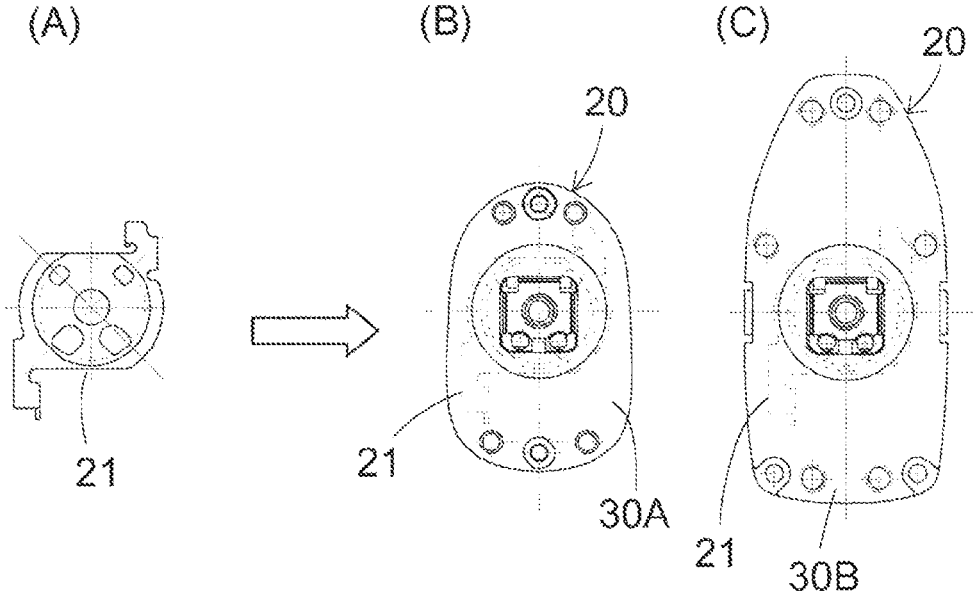
FIGS. 8(A)-(C) are explanatory views in case where a profile of the base is modified corresponding to a shape of a bottom face of the case, by commonly using the sheet metal part.

FIG. 8 is a view for explaining when a profile of the base 20 is modified according to a shape of the bottom face of the case, by commonly using the sheet metal part. The sheet metal part 21 in (A) of FIG. 8 is common to the sheet metal part in the embodiment as described referring to FIGS. 1 to 5. When the bottom face of the case has a small shape, a resin part 30A having a small profile has only to be integrally formed with the sheet metal part 21, as shown in (B) of FIG. 8. On the other hand, when the bottom face of the case has a large shape, a resin part 30B having a large profile has only to be integrally formed with the sheet metal part 21, as shown in (C) of FIG. 8.

As described above referring to FIG. 8, it is possible to realize the structure that can cope with differences in size of the case for the antenna device, by commonly using the sheet metal part 21 for holding the amplifier board 3 and conducting the earth connection, and by modifying the shape of the resin molded part surrounding the sheet metal part.

Figure 9:
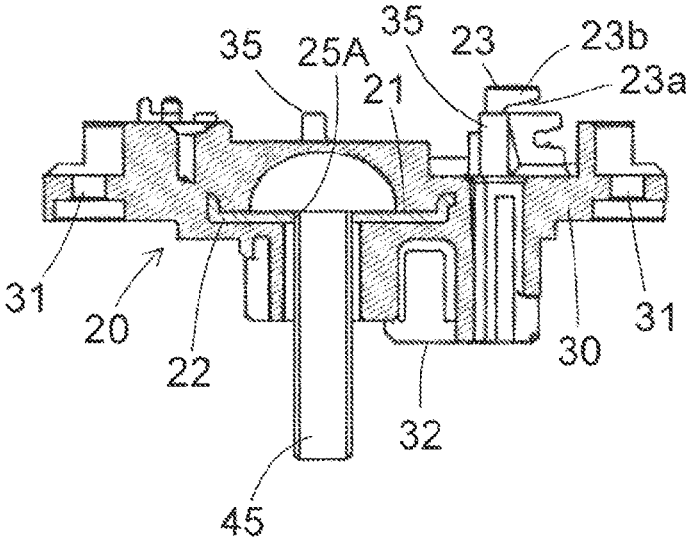
FIG. 9 is a sectional side view showing a structure in another embodiment in which a metal bolt is used in place of a metal nut which is provided on the base side.
Figure 10:
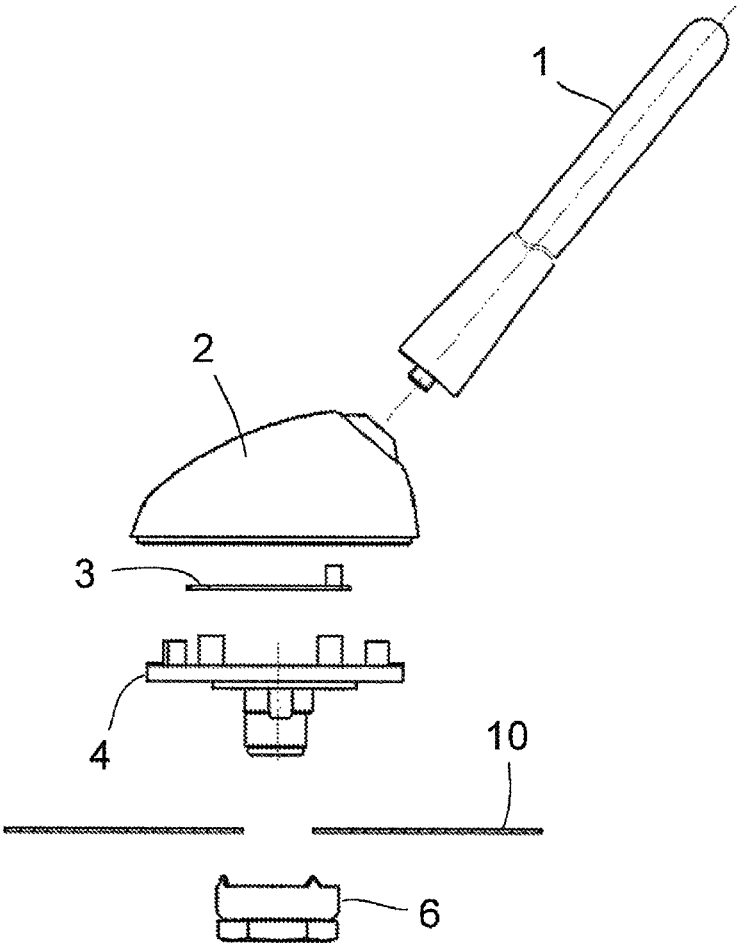
FIG. 10 is an exploded side view of a conventional on-vehicle radio antenna device.

FIG. 9 shows only the base 20 in another embodiment according to the invention. In this case, a bolt fitting hole 25A, instead of the nut positioning hole, is formed in the center part of the bottom face part 22 of the sheet metal part 21. A head of a metal bolt 45 as a metal fastening member, which is passed through the bolt fitting hole 25A, is fixed to the sheet metal part 21 by welding or soldering. The sheet metal part 21 can be mounted to the vehicle panel by using the nut 6 (the metal nut with the hook, for example), in the same manner as the conventional case in FIG. 10.

The embodiment in FIG. 9 has the substantially same operation and effect as the embodiment as shown in FIGS. 1 to 5, except that the metal fastening member is modified.

Although the invention has been heretofore described referring to the embodiments, it is to be understood by those skilled in the art that various modifications can be added to the constituent elements and treating processes in the embodiments, within a scope described in the claims. Some examples of the modifications will be described below.

The metal nut 40 may be fixed and electrically connected to the sheet metal part 21, by mechanical caulking. Moreover, it is possible to form the female screw directly on the sheet metal part 21, after burring work has been applied to the sheet metal part.

The electrical connection between the sheet metal part 21 and the earth electrode 3*a* of the amplifier board 3 can be made by providing at least one arm part 23. However, a plurality of the arm parts 23 may be preferably provided, for the purpose of mechanically holding the amplifier board 3.

In some cases, an amplifier is not mounted on the board, depending on types of the antenna device. However, it is apparent that the invention can be also applied to the antenna device which has the board without the amplifier, inside the case.

DESCRIPTION OF THE REFERENCE NUMERALS AND SIGNS

1 Element
2 Case
3 Amplifier board
3*a* Earth electrode
4, 20 Base
6, 40 Nut

10 Vehicle panel
11, 11A, 11B Mounting hole
21 Sheet metal part
22 Bottom face part
23 Arm part
23*a* Slit
23*b* Folded part
25 Reinforcing rib
26 Nut positioning hole
30, 30A, 30B Resin part
32, 32A, 32B Engaging protruded part
41 Projected part
50 Metal fitting piece
51 Bolt part
52 Hook

The invention claimed is:

1. An antenna device comprising: a case; a board which is encased in the case and receives a signal from an antenna element; and a base which closes a bottom face of the case, wherein the base includes a sheet metal part for conducting earth connection between an earth electrode of the board and a vehicle panel, a metal fastening member fixed to and electrically connected with the sheet metal part, and the sheet metal part is surrounded with resin, wherein a plurality of arm parts are provided, and the board is held by the plurality of the arm parts, and wherein at least one of the plurality of arm parts is erected from a bottom face part of the sheet metal part, and the at least one of the plurality of arm parts is electrically connected to the earth electrode of the board.

2. The antenna device according to claim 1, wherein the sheet metal part has at least one arm part which is erected from a bottom face part thereof, and the arm part is electrically connected to the earth electrode of the board.

3. The antenna device according to claim 1, wherein at least one of the plurality of arm parts has a folded part at a distal end thereof, the folded part being folded and soldered to the earth electrode.

4. The antenna device according to claim 1, wherein the metal fastening member is a stepped nut which has a projected part in a center part thereof, and the sheet metal part is formed with a positioning hole with which the projected part is to be engaged.

5. The antenna device according to claim 1, wherein a reinforcing rib is formed by folding an edge of a bottom face part of the sheet metal part.

6. The antenna device according to claim 1, wherein the sheet metal part is integrally molded with the resin.

7. The antenna device according to claim 1, wherein the metal fastening member is fixed to the sheet metal part by welding.

8. The antenna device according to claim 1, wherein the sheet metal part is formed with a hole, and the metal fastening member comprises:

a first portion disposed on the sheet metal part; and a second portion inserted into the hole.

9. The antenna device according to claim 1, wherein the sheet metal part is formed with at least one of a rib and a stepped portion.

10. The antenna device according to claim 1, wherein the metal fastening member is fixed to an upper face of the sheet metal part.

* * * * *